US006575004B2

(12) United States Patent
Berton et al.

(10) Patent No.: US 6,575,004 B2
(45) Date of Patent: Jun. 10, 2003

(54) COMBINATION LOCK SYSTEM

(75) Inventors: Cyril Berton, Juvisy sur Orge (FR); Gérard Cheriot, Pontault-Combault (FR)

(73) Assignee: Unitechniques, Rungis (FR)

( * ) Notice: Subject to any disclaimer, the term of this patent is extended or adjusted under 35 U.S.C. 154(b) by 0 days.

(21) Appl. No.: 09/898,921

(22) Filed: Jul. 3, 2001

(65) Prior Publication Data

US 2001/0045112 A1 Nov. 29, 2001

(30) Foreign Application Priority Data

Jul. 5, 2000 (FR) ..... 00 08715

(51) Int. Cl.[7] ..... E05B 37/02

(52) U.S. Cl. ..... 70/313; 70/214; 70/304; 70/305; 70/306; 70/308; 70/312

(58) Field of Search ..... 70/313, 214, 304, 70/305, 306, 308, 312, 328

(56) References Cited

U.S. PATENT DOCUMENTS 3,379,040 A * 4/1968 Shimono ..... 70/313
3,667,261 A * 6/1972 McGourty ..... 70/214
4,385,509 A * 5/1983 Milles et al. ..... 70/304
4,748,833 A * 6/1988 Nagasawa ..... 70/214
4,827,743 A * 5/1989 Kim ..... 70/214
4,848,116 A * 7/1989 Lizotte ..... 70/306
6,000,254 A * 12/1999 Raybary ..... 70/133
6,298,698 B1 * 10/2001 Nakajima et al. ..... 70/214
6,334,346 B1 * 1/2002 Wang ..... 70/214

* cited by examiner

*Primary Examiner*—Anthony Knight
*Assistant Examiner*—Christopher Boswell
(74) *Attorney, Agent, or Firm*—Merchant & Gould P.C.

(57) ABSTRACT

A combination lock system comprising a set of push-buttons, a set of series of coders each of which series is associated with a push-button, incrementing means for placing the coders of each series successively in a position to be operated by a push-button, coding means for selecting some coders and placing them in a coding position, and means for returning the coders to a waiting configuration after the push-buttons are actuated. The system comprises means for authorizing two actuation strokes of the push-buttons, namely a normal stroke commanding movement of a coder which is part of the code between its coding position and an unlocking position and a coding travel moving a coder from its inactive position to its coding position. For entering a new coded combination, the system further comprises means for placing all the coders in the inactive position and authorizing actuation of the push-buttons over the coding stroke.

16 Claims, 14 Drawing Sheets

COMBINATION LOCK SYSTEM

FIELD OF THE INVENTION

The present invention relates to a combination lock system comprising a set of push-buttons that can be actuated in compliance with a combination, a set of series of coders, in which each series is associated with a push-button, incrementing means for placing the coders of each series successively in a position to be operated by actuating a push-button, coding means for defining a waiting configuration of the coders in which the coders selected for the combination occupy a coding position and the coders not selected for the combination occupy an inactive position, actuation of the locking means of the lock being possible if the selected coders have been operated by actuating push-buttons in compliance with the combination, the system further comprising means for returning the coders to the waiting configuration after actuation of the push-buttons.

Each push-button is associated with a series of several coders, for example four or five coders. In a waiting position, each first coder of each series is ready to be operated by a corresponding push-button. As soon as a push-button has been depressed, the incrementing means place the second coders of each series in a position to be operated by the corresponding pushbutton, and so on. The incrementing means therefore enable the same push-button to be used more than once in the coded combination, up to a limit which is the number of coders in each series.

The push-buttons generally comprise numeric push-buttons and possibly two or three alphabetic push-buttons. Being able to use the same push-button more than once in the coded combination considerably increases the number of combinations available.

The lock can be opened when the correct combination has been entered by actuating the push-buttons. Otherwise the lock remains locked. In both cases the coders can be returned to a waiting position for a new attempt to open the lock.

BACKGROUND OF THE INVENTION

U.S. Pat. No. 4,827,743 discloses a system of the above kind in which the coders are rotary coders and have two arms in a V arrangement. Depending on whether a coder is part of the coded combination or not, actuating the corresponding push-button moves the coder in one rotation direction or the other. Moving a coder in the "right" rotation direction unlocks the lock, which is not possible if a coder is moved in the "wrong" rotation direction.

The number of coders used in this kind of coded combination lock system can be very large. For example if the push-buttons comprise ten numeric push-buttons and each series of coders comprises five coders, not less than 50 coders will be necessary. Coding the combination necessitates putting all these coders in a correct position relative to each other, which, given their number, is difficult and time-consuming.

U.S. Pat. No. 4,827,743 uses the push-buttons for entering the combination to carry out the coding. To this end, the user obtains access to the coders from the inside of the lock, which is the side opposite that carrying the push-buttons, and then, by means of a pivoting panel, sets all the coders to the same inactive position. The user then enters the new combination by means of the push-buttons, which places the selected coders in an intermediate position in which they are offset angularly relative to the other coders. The user then closes the panel previously used to place all the coders in the inactive position; this movement of the panel entrains only the selected coders, increasing their angular offset relative to the coders that are not part of the combination and placing them in their coding position.

This system has the advantage of avoiding manual manipulation of all the coders. However, if a new code is entered by means of the push-buttons, all of the selected coders must first occupy an intermediate angular position before they have to be moved into a coding position by rotating the panel. In effecting this latter operation, the user must ensure that all the selected coders have been placed in their correct intermediate position, i.e. with a sufficient angular offset relative to the coders have not been selected for them to be selectively entrained in rotation by pivoting the panel. The user must in particular ensure that the push-buttons have been depressed sufficiently for all the selected coders to have been moved through a sufficient angular displacement relative to the coders that have not been selected and have remained in their intermediate position.

In the system disclosed in U.S. Pat. No. 4,827,743, depressing a push-button which is part of the combination moves the corresponding coder in a first rotation direction, the effect of which is to actuate a first flap which in turn, via two ratchet systems, moves an incrementation bar and a locking bar. Pressing a push-button that is not part of the combination moves the corresponding coder in a second rotation direction, which actuates a second flap which actuates the first flap via a connecting arm, the effect of which is to cause the first ratchet system to move the incrementation bar, but the connecting arm lifts a pawl which prevents incrementing the displacement of the locking bar.

The two push-buttons operate neither the same parts nor the same number of parts. Consequently, the aware user inevitably detects a tactile difference and an audible difference between the two push-buttons and can therefore recognize the one that is not part of the combination. There is therefore a risk that the code can eventually be detected.

OBJECTS AND SUMMARY OF THE INVENTION

The present invention applies to this type of coded combination lock and aims to simplify further the coding operation.

That aim is achieved by the invention providing a system comprising means for authorizing two actuation strokes of the push-buttons, namely a normal stroke and a coding stroke, the normal stroke being such that a push-button actuated over that stroke causes the movement of a selected coder from its coding position to a non-locking position or the movement of an unselected coder from its inactive position to a locking position preventing unlocking, while the coding stroke is such that a push-button actuated over that stroke causes a coder to be moved from its inactive position to its coding position and the system further comprising means which, to enable entry of a new coded combination, place all the coders in the inactive position and authorize actuation of the push-buttons over their coding stroke.

The normal stroke of the push-buttons is that allowed for entering the combination to open the locking means of the lock. The coding stroke is used only to change the combination. For this purpose, the authorized user actuates the means for authorizing the coding stroke, in general from the side of the lock that is inside the protected area (the inside of the door fitted with the lock). Before entering a new combination, the user places all the coders in the inactive position and then enters the new combination using the push-buttons, which are manipulated in exactly the same way as when using the lock normally, except that the stroke of the push-buttons is different from the normal stroke. Then, when the new combination has been entered, it is no longer necessary to move coders, and it is sufficient to reset the stroke of the push-buttons to the normal stroke and to reset the incrementing means, for example by actuating the door handle.

The coding stroke is preferably longer than the normal stroke of the push-buttons.

The displacement of a selected coder from its coding position to its unlocking position is preferably the same as the displacement of a selected coder from its inactive position to its locking position and actuating the push-buttons preferably affects only the incrementing means and the coders.

Accordingly, actuating a push-button that is part of the combination and actuating a push-button that is not part of the combination have exactly the same subjective effect, so the user cannot detect any difference, in particular any tactile or audible difference, between actuating the two push-buttons.

Each coder advantageously has spaced first and second unlocking markers and, in the unlocking position of a selected coder, the second unlocking marker of said coder is disposed in corresponding relationship with the first unlocking markers of the coders in the inactive position.

In this type of lock, unlocking is possible when all the coders have locking markers disposed in a corresponding relationship, generally aligned with each other. In their waiting position, the coders selected for the combination are offset relative to the inactive coders. The offset is such that, if the selected coders are moved to the unlocking position, the second unlocking markers of the selected coders come into corresponding relationship with the first unlocking markers of the unselected coders, which have remained in the inactive position. Accordingly, even in the unlocked position, the selected coders are offset relative to the unselected coders. This facilitates resetting, which consists of returning the coders to the waiting position after actuation of the push-buttons. This is because, at the time of a reset, the selected coders which are in the unlocking position are selectively moved to the coding position and any unselected coders that may happen to be in the locking position are returned to the inactive position.

In this case, it is advantageous if each coder has spaced first and second actuation surfaces respectively adapted to cooperate with a push-button in order, when the push-button is depressed, to cause the coder to be moved between its inactive position and its locking position and between its coding position and its unlocking position.

If actuating the push-button operates a selected coder, then the latter is moved from its coding position to its unlocking position. On the other hand, if actuating the push-button operates an unselected coder, it is moved from its inactive position to its locking position. These positions are offset relative to each other.

A push-button actuated in error moves an unselected coder in the same way that a push-button actuated in conformance with the combination moves a selected coder. Accordingly, all the push-buttons appear to react in the same way when actuated. A person entering an incorrect combination is therefore unable to identify the push-button actuated in error.

It is also advantageous if each coder has spaced first and second reset surfaces and the means for returning the coders to the waiting configuration after the push-buttons are actuated comprise a reset member adapted to co-operate with the first reset surfaces of the coders occupying the locking positions to return said coders to their inactive positions and to co-operate with the second reset surfaces of the coders occupying their unlocking positions to return said coders to their coding positions.

On the other hand, at the time of a reset, the reset member preferably moves neither the unselected coders that have remained in the inactive position nor the selected coders that have remained in the coding position. The resetting surfaces are therefore disposed so that the resetting surfaces of a coder in the inactive position escape from the resetting member in the same way that the resetting surfaces of a coder in the coding position escape from that member.

The system advantageously comprises coupling means between the operating means of the lock, such as a square operating shaft, and the locking means of the lock, said coupling means having a non-interlocked configuration at rest and means for placing the coupling means in an interlocked configuration if the push-buttons have been operated in compliance with the correct combination, in which interlocked configuration the locking means are coupled to the lock operating means.

Accordingly, if the correct combination has not been entered, the lock operating means are not interlocked with the locking means and turn freely if they are operated by the user, for example by means of a handle.

The user who has entered a combination on the push-buttons naturally attempts to verify if the combination is correct by attempting to open the lock by manipulating operating means such as the handle.

The means for returning the coders to the waiting position after actuation of the push-buttons advantageously comprise a reset member that can be actuated by manipulating the lock operating means.

The virtually inevitable actuation of the lock operating means is therefore exploited to perform the reset.

The system advantageously comprises a free passage function which enables actuation of the locking means of the lock by the operating means of the lock without actuating the push-buttons.

It is obviously preferable for activation of this free passage function to be possible only for an authorized user, and therefore preferably after correct use of the coded combination. This is the case in particular if the function can be activated only from the inside of the lock, inside the protected area. The free passage function momentarily bypasses the coders of the lock, as it were. For example, this enables the premises at whose entry the lock is provided to be protected at only certain times of day or only if the usual occupant is not present.

BRIEF DESCRIPTION OF THE DRAWINGS

The invention will be better understood and its advantages will become more clearly apparent on reading the following detailed description of one embodiment, which is shown by way of non-limiting example. The description refers to the accompanying drawings, in which.

MORE DETAILED DESCRIPTION

Figure 1:
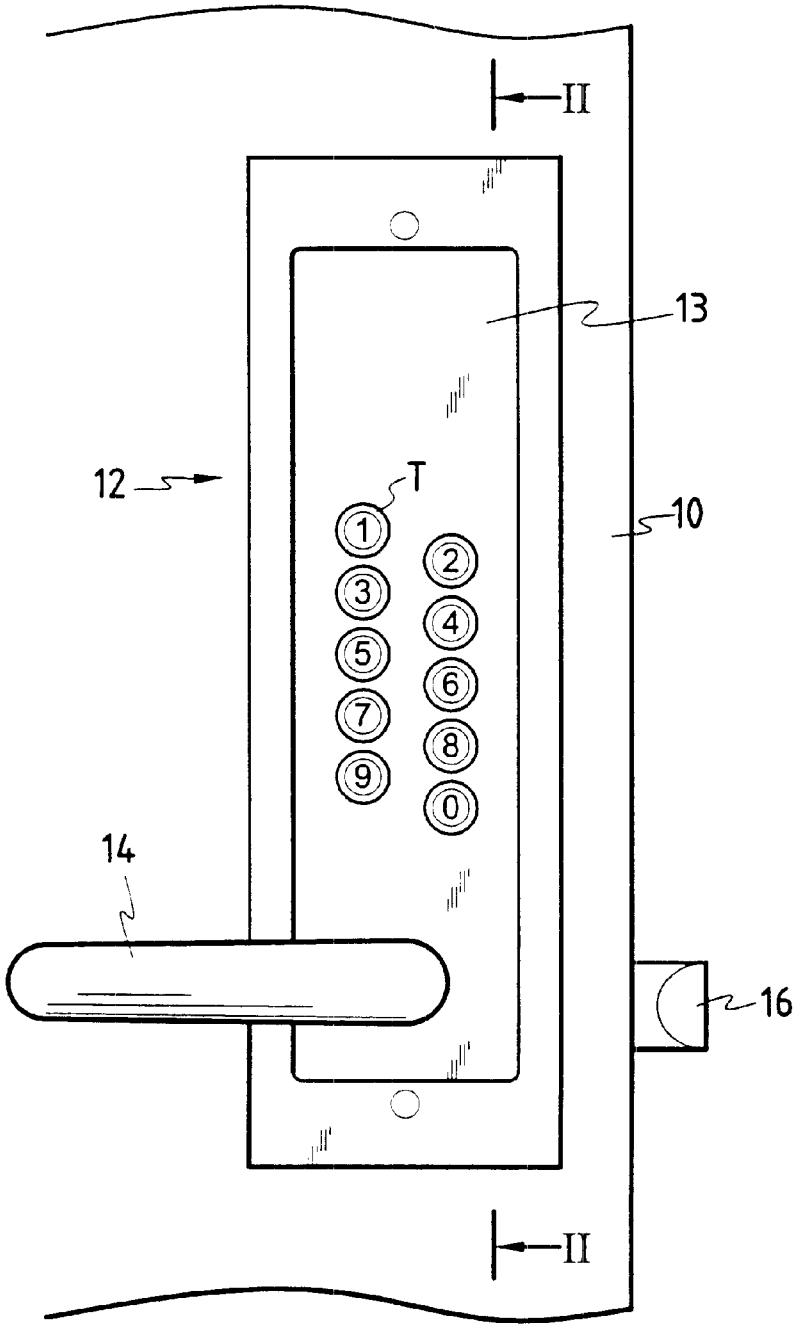
FIG. 1 is a diagrammatic exterior view of a door equipped with a combination lock system according to the invention.

Referring to FIG. 1, a door 10 is equipped with a combination lock system 12 according to the invention which comprises a set of push-buttons T disposed on a panel on the outside of the door. In this example there are ten numeric push-buttons arranged as two rows each of five push-buttons. If the correct combination is entered by manipulating the push-buttons, locking means of the lock, such as a bolt 16, can be opened by actuating a door handle 14.

The lock is installed on the outside face of a door, whose inside face is the opposite face. The outward direction is that from the inside face towards the outside face. In the conventional way, the two rows of push-buttons are oriented vertically and the longitudinal direction of the lock system, to which the transverse direction is perpendicular, is the vertical direction.

Figure 2:
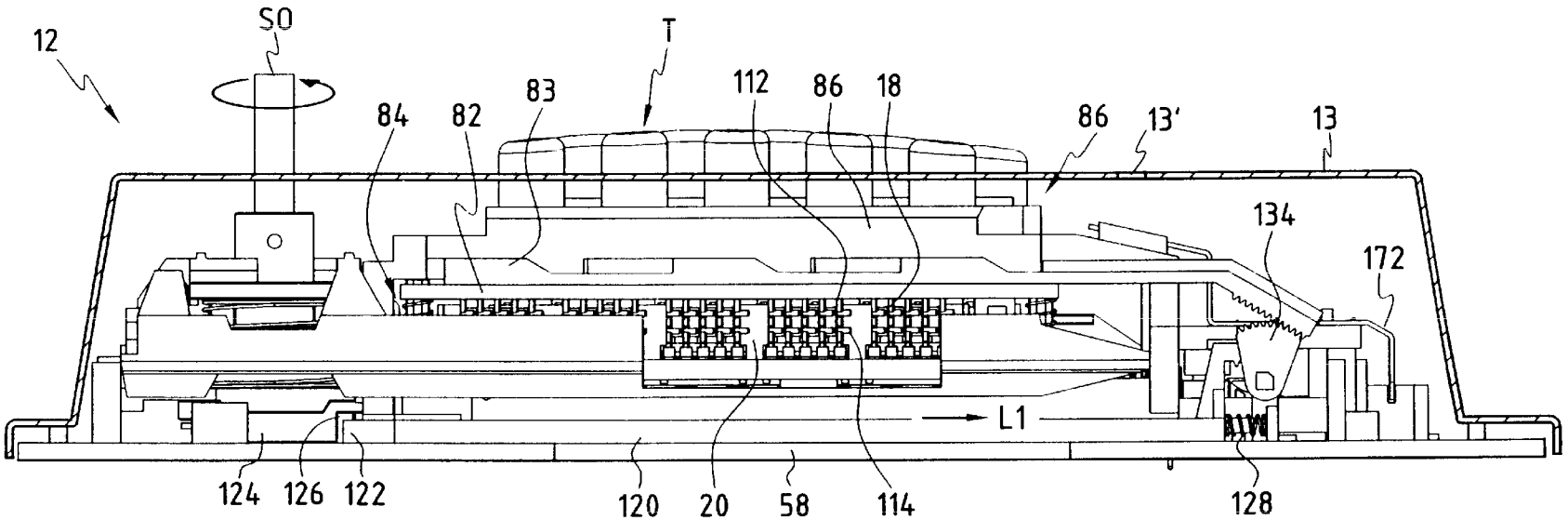
FIG. 2 is a view in section taken along the line II—II in FIG. 1.
Figure 3:
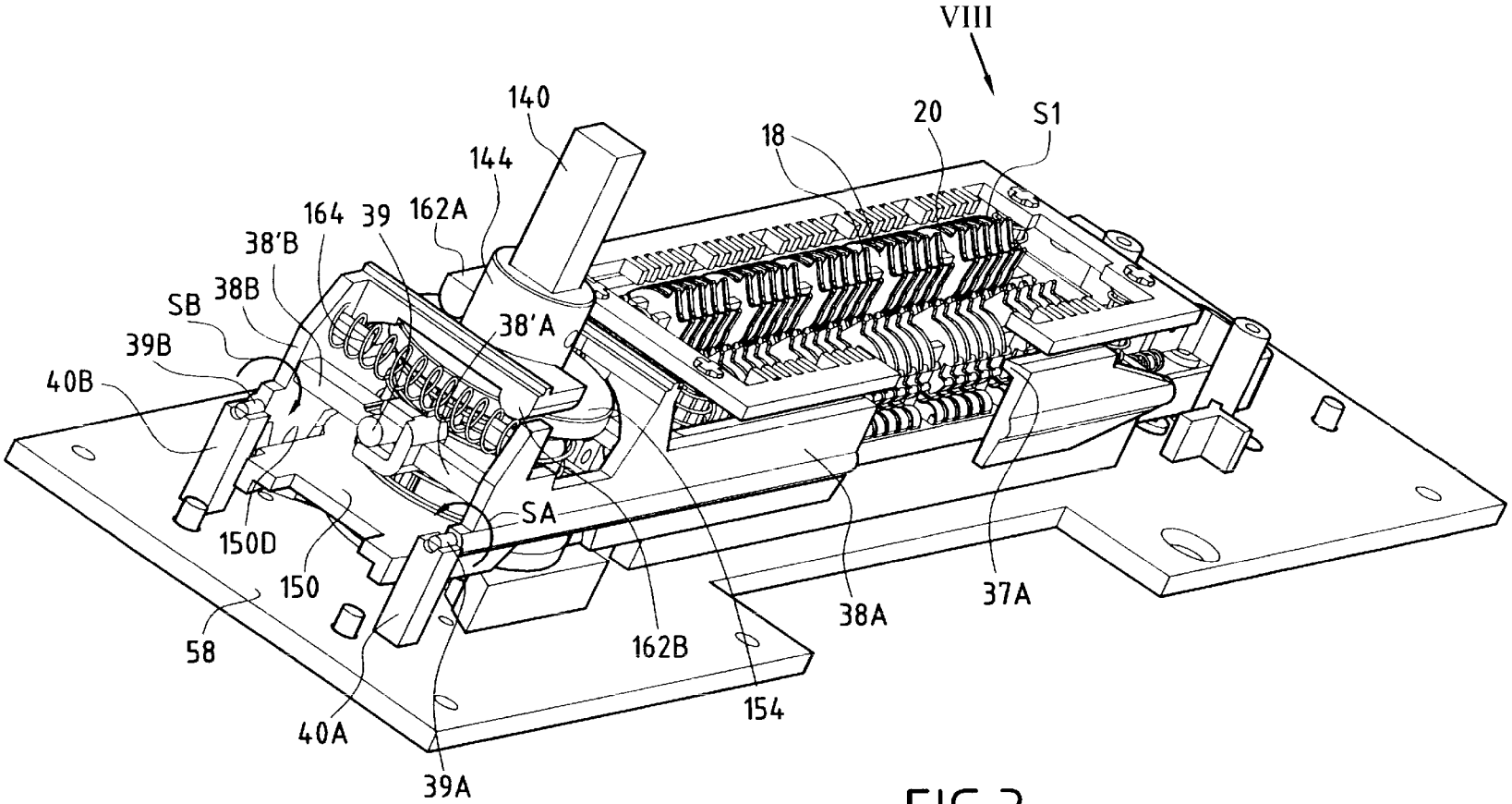
FIG. 3 is a perspective view of the lock shown in FIG. 2, without its protective casing and the push-button support block located immediately under the casing.
Figure 4:
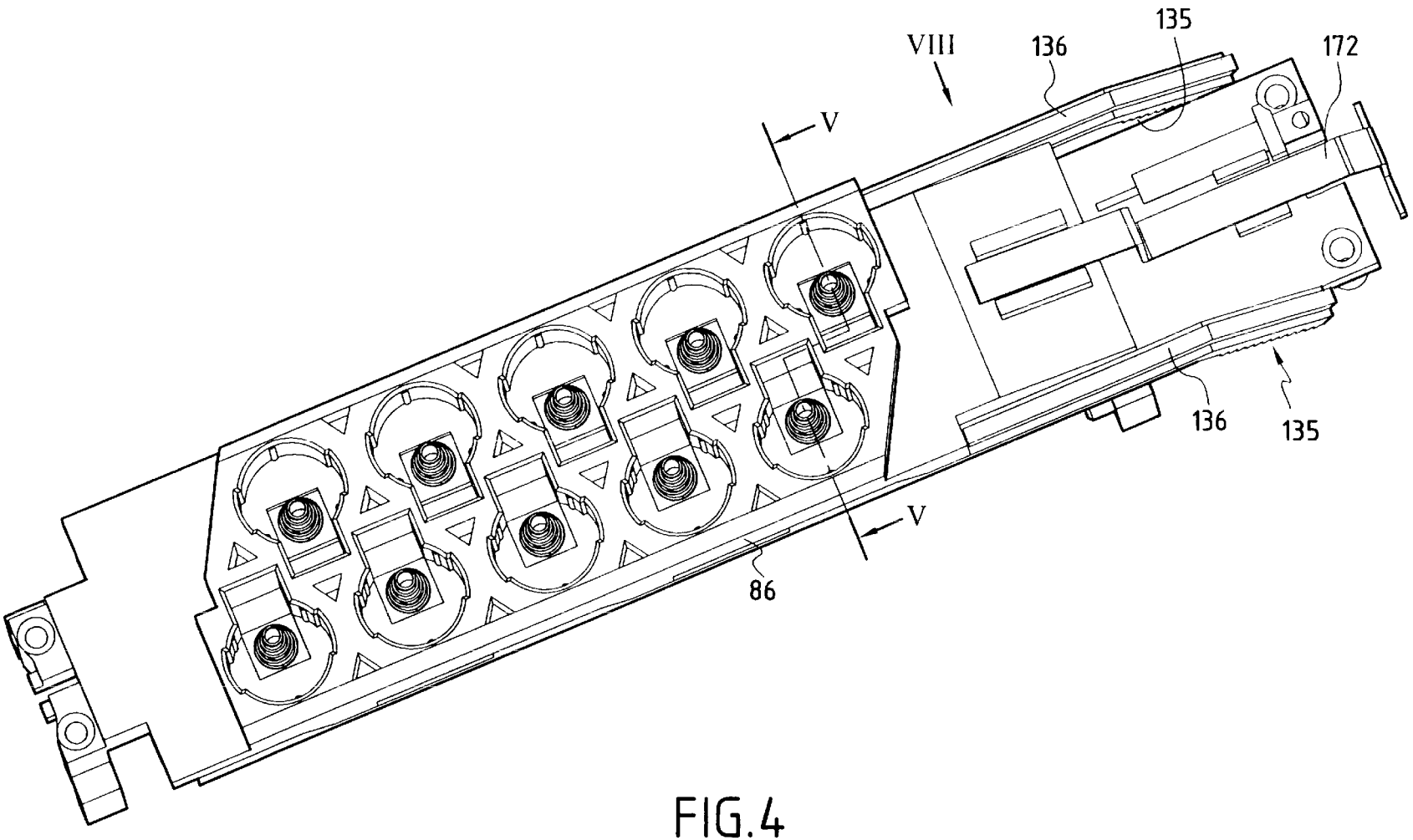
FIG. 4 is a perspective view of the push-button support block that is absent from FIG. 3.

The section plane of FIG. 2 is aligned with one side of the casing 13 of the lock system and this sectional view shows internal components of the system. FIG. 3 also shows that the lock system comprises a set of series of coders 18. Each series is associated with a push-button and comprises several coders. The series S1 is associated with numeric push-button 1, for example. The coders in each series are separated from each other by spacers (not shown) and the series are separated from each other by spacers 20. As shown in FIG. 3, the series of coders are disposed in two rows each comprising five series of coders.

If the push-buttons are depressed successively, the coders of the same series are successively placed in a condition where they can be operated by actuating the corresponding push-button. In this example each series comprises five coders and so the same push-button can be used up to five times in the combination for unlocking the lock.

Figure 7:
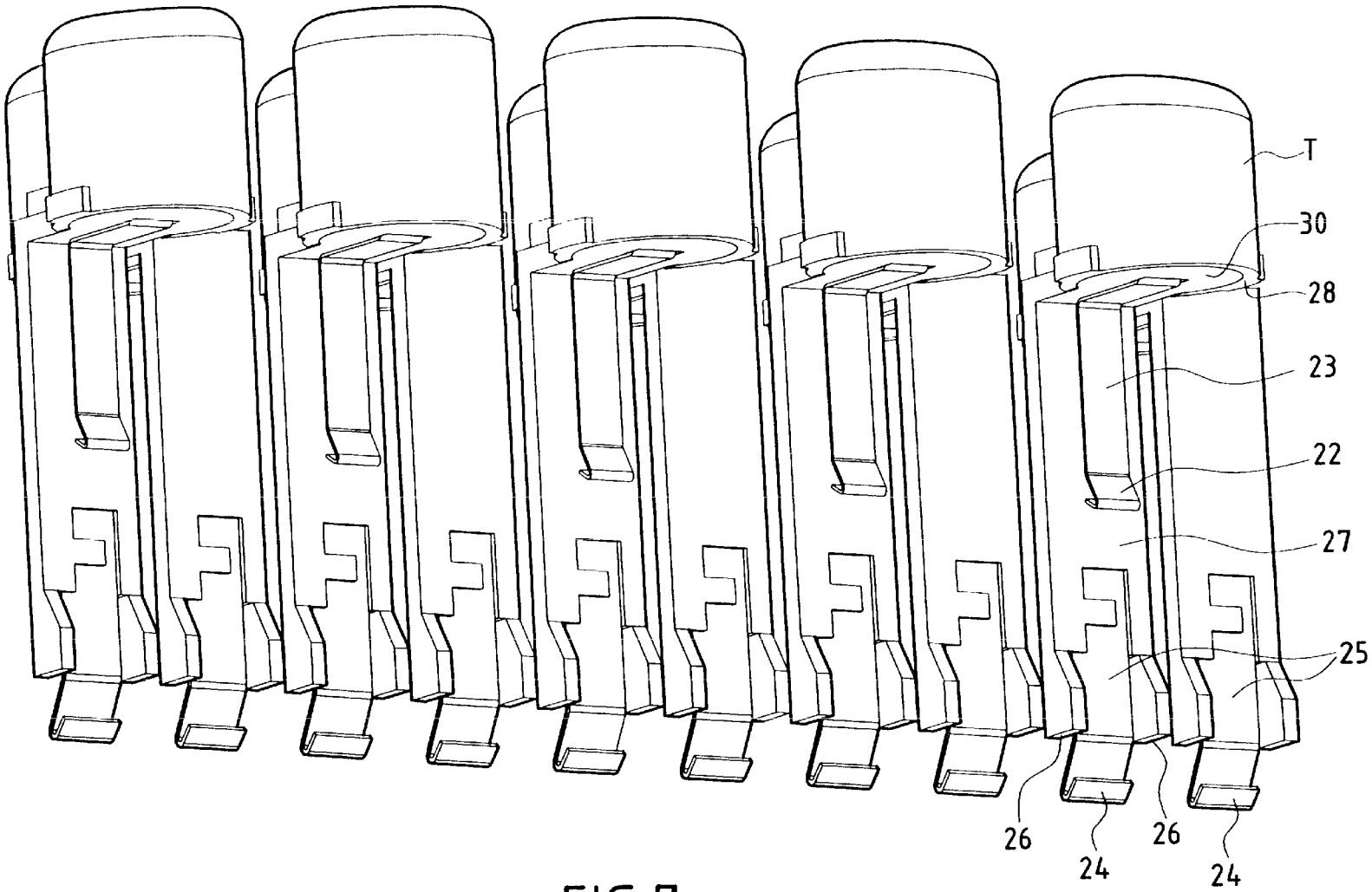
FIG. 7 is a perspective view of all the push-buttons with their actuator arms.

The perspective view of the push-buttons in FIG. 7 shows that each push-button T comprises a first actuator member 22 adapted to cooperate with the coders of the series associated with that push-button, a second actuator member 24 adapted to cooperate with the incrementing means, and a third actuator member 26 which, as described later, provides an abutment arm defining the normal stroke of the push-button and a locking member cooperating with the incrementing means.

As shown in FIG. 7, the actuator members take the form of blades which project under the push-button. To be more precise, and as can also be seen in the FIG. 5 sectional view, the push-button T has a cap 28 inside which is a stud 30 which is spring-loaded by a return spring 32 which bears on the push-button support block. The first actuator member 22 is formed at the free end of a blade 23, for example a spring steel blade, whose upper end opposite the free end is carried by the stud 30. The third actuator member 26 is formed at the free end of an extension arm 27 which extends downwards from the stud, with which it is in one piece. The second actuator member 24 is formed by the free end of a blade 25 fixed to the extension arm 27. In this example a cavity to receive the blade 25 is formed at the end of the arm 27, so that its free end is divided into two parts 26 that extend one on each side of the blade 25.

Figure 5:
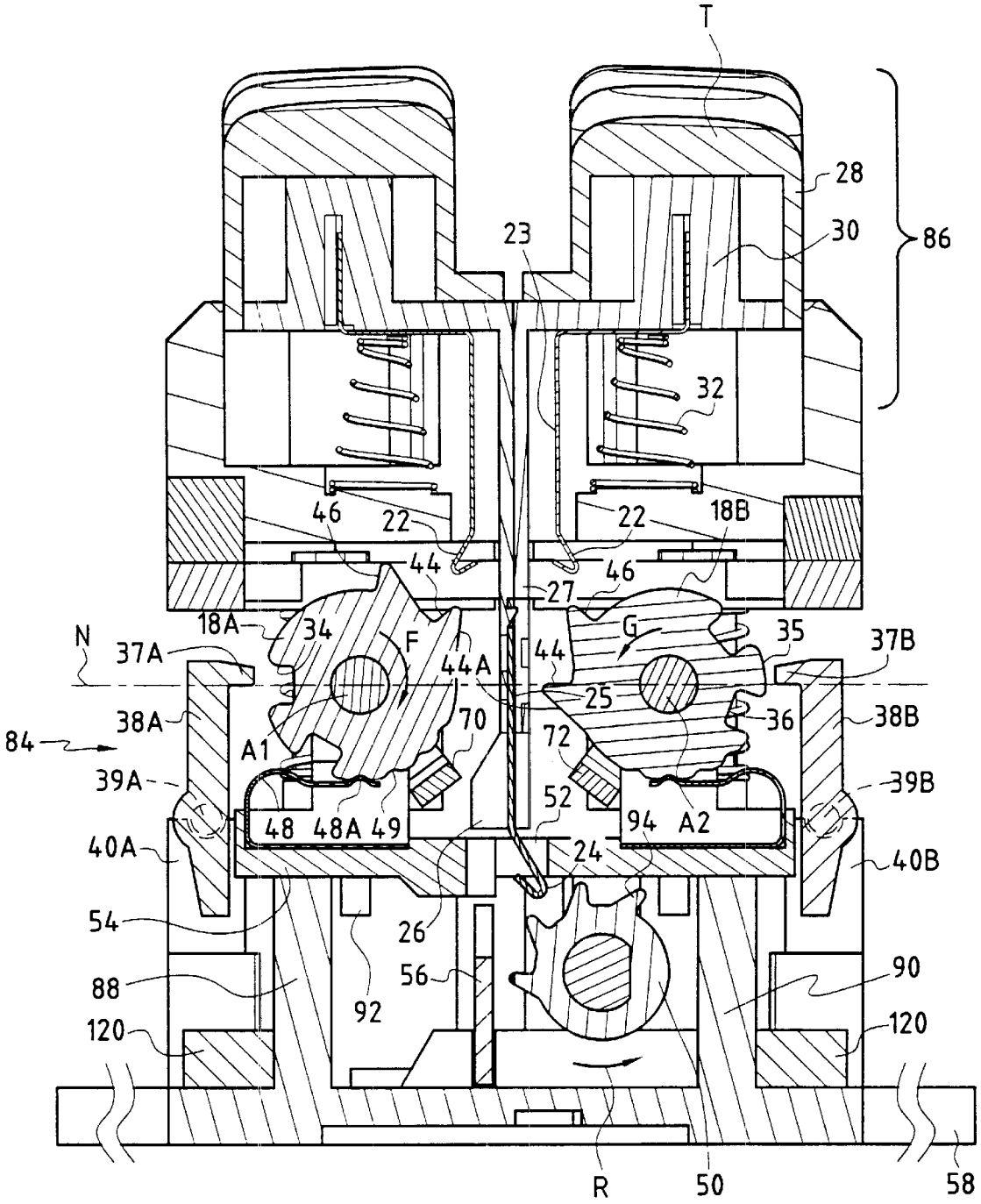
FIG. 5 is a view in cross-section taken along the line V—V in FIG. 4.

FIG. 5 shows that the coders are rotary coders. Accordingly, the coders corresponding to the push-buttons of the right-hand row in FIG. 1 are rotatable about a first shaft A1, like the coder 18A, and those that correspond to the push-buttons of the left-hand row are rotatable about a shaft A2, like the coder 18B. The shafts A1 and A2 define two longitudinal geometrical lines along which the respective coders corresponding to each of the two rows of push-buttons are aligned.

The coders can be moved in a first rotation direction by actuating the push-buttons and in the opposite rotation direction to return them to a waiting position after actuation of the push-buttons.

In this example, all the coders are identical, but the choice has been made to dispose the coders mounted on the shaft A1 symmetrically to the coders 18B mounted on the shaft A2 with respect to a median plane of symmetry between the shafts A1 and A2.

Accordingly, FIG. 5 shows that the first rotation direction F of the coders rotating on the shaft A1, in which they are driven by actuating the push-buttons, is opposite the first rotation direction G of the coders rotating about the shaft A2.

As can be seen better in FIG. 7, the symmetrical arrangement of the coders means that, despite the arrangement of the push-buttons in two rows, the second actuator member 24 and the third actuator member 26 of all the push-buttons are substantially aligned with the median axis between the shafts A1 and A2, one particular advantage of which is to simplify the configuration of the incrementing means.

FIG. 5 shows the coder 18B in its coding position. The coder 18A is shown in the inactive position. FIG. 5 and FIGS. 6A to 6F show that each coder 18 has a first unlocking marker 34 and a second unlocking marker 36 that are spaced from each other and separated by a locking marker 35.

Figure 6A:
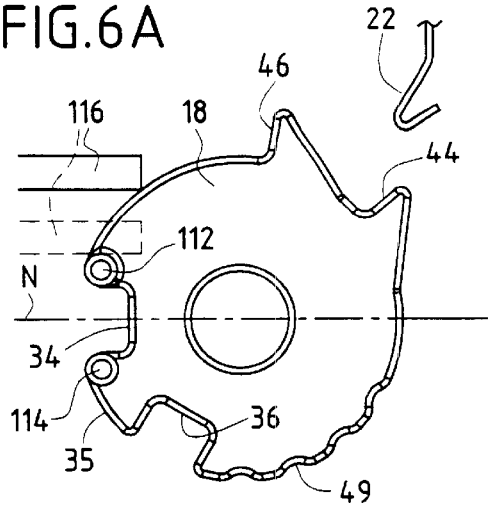
FIGS. 6A to 6F show diagrammatically various positions that the coders of the locking system can adopt.
Figure 6B:
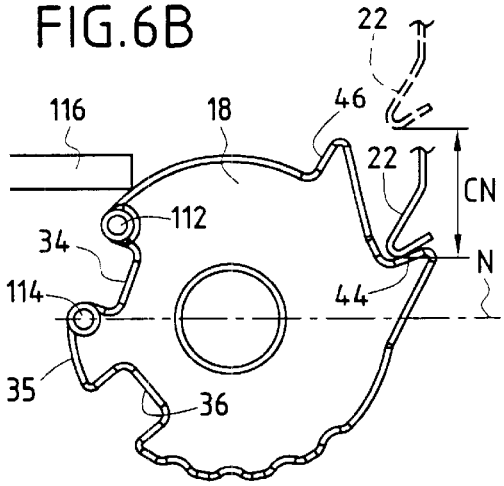
Figure 6C:
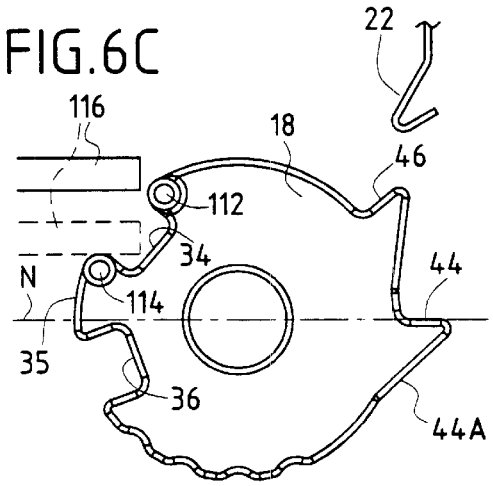
Figure 6D:
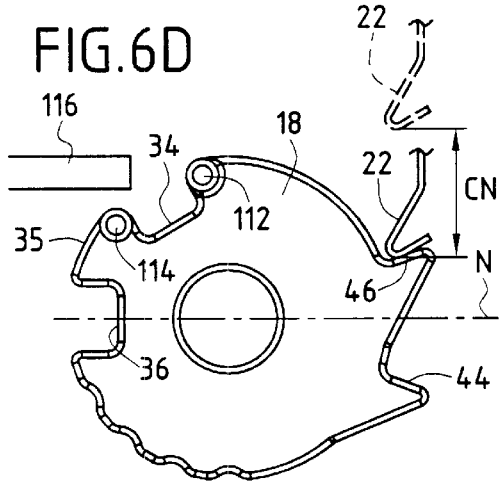

FIG. 6A shows a coder 18 in its inactive position, which is that of the coder 18A in FIG. 5. FIG. 6C shows a coder 18 in its coding position, which (through considerations of symmetry) is that of the coder 18B in FIG. 5. FIG. 6D shows the unlocking position of the same coder, which is that it occupies after it has been operated by depressing a push-button. The positions of the first actuator member of the push-button corresponding to that coder at rest (FIGS. 6A and 6C) and at the end of the normal travel CN (FIGS. 6B and 6D) are shown diagrammatically.

The reference N indicates the level occupied by the first unlocking markers of the coders in the inactive position. Comparing FIGS. 6A and 6D shows that the second unlocking marker 36 of the coder 18 that is part of the code that has been operated by the correct push-button is at the same level N as the first unlocking marker 34 of the coder 18 that is not part of the code and has not been operated.

Accordingly, if the correct combination has been entered, so as to all the coders selected for the combination are operated correctly, all the second locking markers of the selected coders are at the same reference level N as the first unlocking markers of the unselected coders and not operated by the push-buttons. As shown later, this enables the lock to be unlocked.

However, FIG. 6C shows that before it was operated by depressing a push-button, the coder 18 that is part of the code is in a position such that its locking marker 35 is at the reference level N, which prevents unlocking the lock. Similarly, FIG. 6B shows the position of the coder 18 that is not part of the code and has been operated in error by depressing a push-button. In this position the locking marker of the coder is also at level N.

In this example the coders are in the form of disks and the unlocking markers 34 and 36 are in the form of peripheral notches in the disks, between which a portion with no notches forms the locking marker.

FIG. 5 shows that the system comprises two pivoting bars 38A and 38B respectively associated with the row of coders 18A and the row of coders 18B. In cross section, the bars take the form of levers pivoting on respective shafts 39A and 39B supported by respective bearings 40A and 40B. Clearly, if only the unlocking markers 34 or 36 are at the level N, the levers 38A and 38B can respectively pivot through a maximum stroke in the direction F and in the direction G and enter the notches 34 or 36. This is the case for the bar 38B.

On the other hand, if a coder occupies a position such that its locking marker 35 is at the level N, it limits pivoting of the bar 38A or 38B to a stroke less than that maximum stroke. This is the case for the bar 38A.

As explained later, the bars 38A and 38B constitute locking members which, if they move over their maximum stroke, engage the square operating shaft of the lock with its locking means 16. The periphery of the coders comprises two indentations 44 and 46 that respectively constitute the first and second actuator surfaces of the coders. It is clear from FIG. 5 that, in the inactive position of the coder 18A, its first actuator surface 44 can co-operate with the corresponding push-button, or to be more precise with the first actuator member 22 of that push-button, to turn the coder in the direction F through one rotation angular step. On the other hand, for the coder 18B in its coding position, the second actuator surface 46 can co-operate with the actuator member 22 of the corresponding push-button to turn that coder through a rotation angular step in the direction G.

Sticking points advantageously determine the various angular positions of the coders. To this end, a leaf spring 48 with a ripple 48A is disposed under each coder. The coder associated with the leaf spring has a series of four ripples 49 on its periphery which selectively co-operate with the ripple 48A on the leaf spring to determine the various angular positions of the coder, namely its inactive position and, successively in the first rotation direction of the coder, its locking position, its coding position and its unlocking position.

If the push-buttons are depressed through their normal stroke, they rotate the coders by one rotation angular step corresponding to moving a coder either between its inactive position and its locking position or between its coding position and its unlocking position.

When a push-button is depressed, its second actuator member 24 cooperates with an incrementing shaft 50 which is part of incrementing means described later. Its extension arm 27 passes through a slot 52 in the plate 54 that supports the springs 48 to lock the incrementing means momentarily, as explained later.

The system according to the invention comprises a stroke limiter 56 which has abutment surfaces and which can be moved between a first position in which the abutment surfaces face the abutment arms of the push-buttons (in this example, arms at the free ends 26 of the extension arms 27) to limit the stroke of the latter to their normal stroke CN, and a second position in which said abutment surfaces are moved away from the abutment arms 26, to allow the push-buttons to move over their coding stroke CC.

Figure 10:
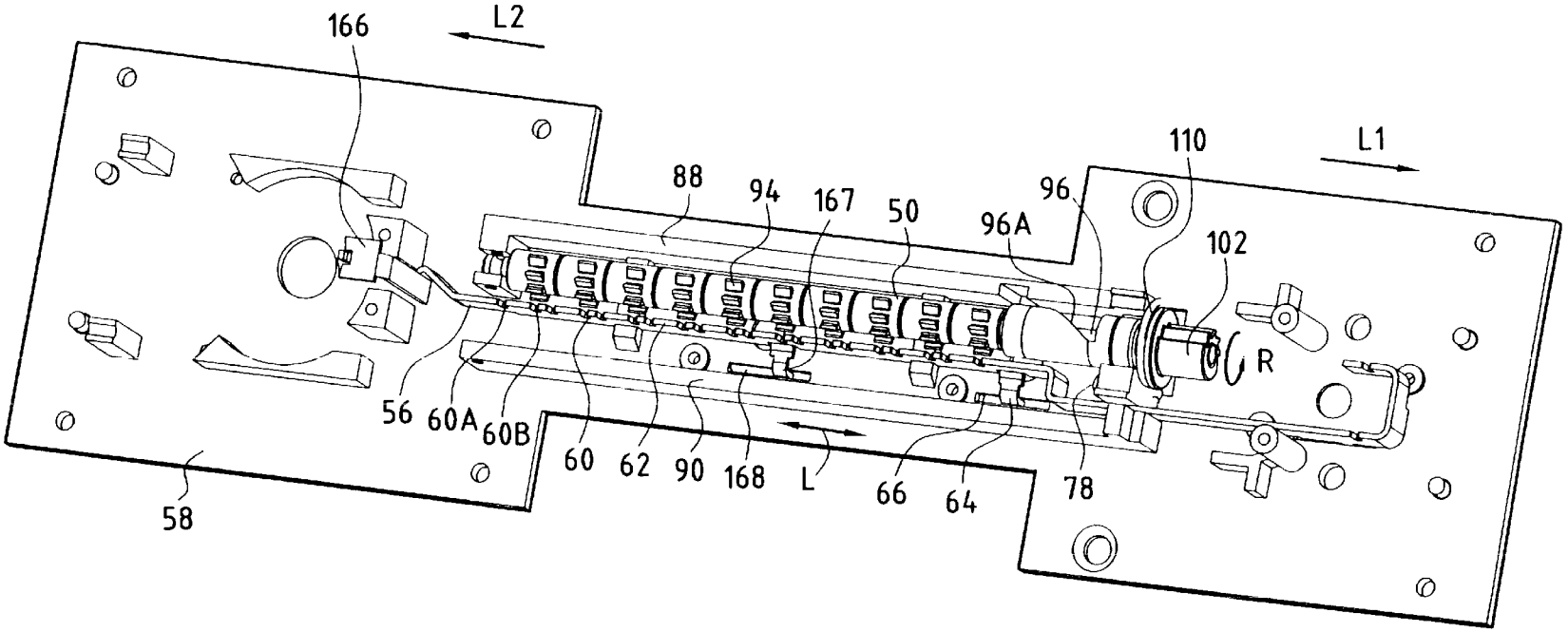
FIG. 10 is a perspective view of part of the incrementing means.
Figure 13:
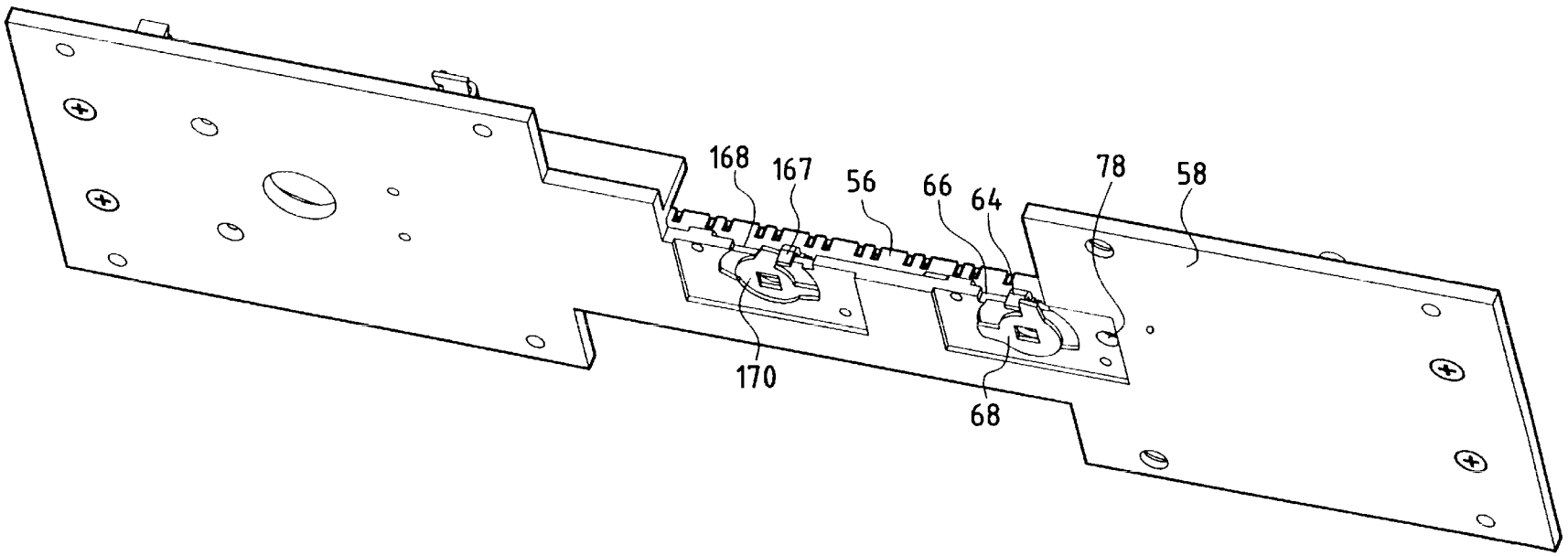
FIG. 13 is a bottom view of FIG. 10.

In this example, the stroke limiter is a bar that can move in translation and can be seen in FIGS. 10 and 13. FIG. 10 is a plan view showing the plate 58 that forms the base-plate of the lock system and is fixed to the outside of the door. The plate carries the various components of the lock system, in particular the incrementing shaft 50 and the stroke limiter bar 56.

For convenience, the components of the lock system above the incrementing shaft 50 are not shown in FIG. 10. The stroke limiter bar can be moved in translation as indicated by the double-headed arrow L in FIG. 10. Its upper end, opposite the plate 58, comprises notches 60.

In its first position, limiting the stroke of the push-buttons to their normal stroke, the stroke limiter bar is disposed so that the notches 60 are offset relative to the free ends 26 of the extension arms 27 of the push-buttons. Said free ends 26 therefore abut against abutment surfaces consisting of the gaps 62 between the notches 60. The stroke limiter occupies this first position under normal conditions of use of the lock, in which the coded combination must be entered by actuating the push-buttons to unlock the lock.

From this first position, the stroke limiter bar can be moved to place the notches 60 in front of the abutment arms 26, thereby allowing the push-buttons to move over a coding stroke greater than their normal stroke. Referring to FIG. 7, it was previously stated that the abutment arms 26 consisted of the two free end parts of the actuator arms 27 of the push-buttons, between which the second actuator member 24 is located. The notches 60 on the stroke limiter bar are disposed in pairs 60A, 60B, each corresponding to one of these end parts.

The stroke limiter bar is naturally protected from manipulation by an unauthorized user. The means for moving the bar in this example comprise an actuator lug 64 that is fastened to the bar and passes through a slot 66 in the plate 58 so that it projects from the rear of the plate, as can be seen in FIG. 13, in which a portion of the plate has been cut away. The lug 64 cooperates with a displacement actuator member 68 which in this example consists of an actuator cam 68 that can be driven in rotation by a square operating shaft (not shown) manipulated from the inside of the door on which the combination lock is mounted.

The system also comprises means described with reference to FIGS. 5, 9, 10, 11 and 13 for placing all the coders in the inactive position for entering a new combination.

The system shown in FIGS. 9 and 11, which comprises in particular the support plate 54, the coders 18 and the resetting member 82 (described below), is referred to hereinafter as the coder block number 84. The coder block 84 is mounted between the plate 58 and the push-button support block 86 (see FIG. 5).

Figure 9:
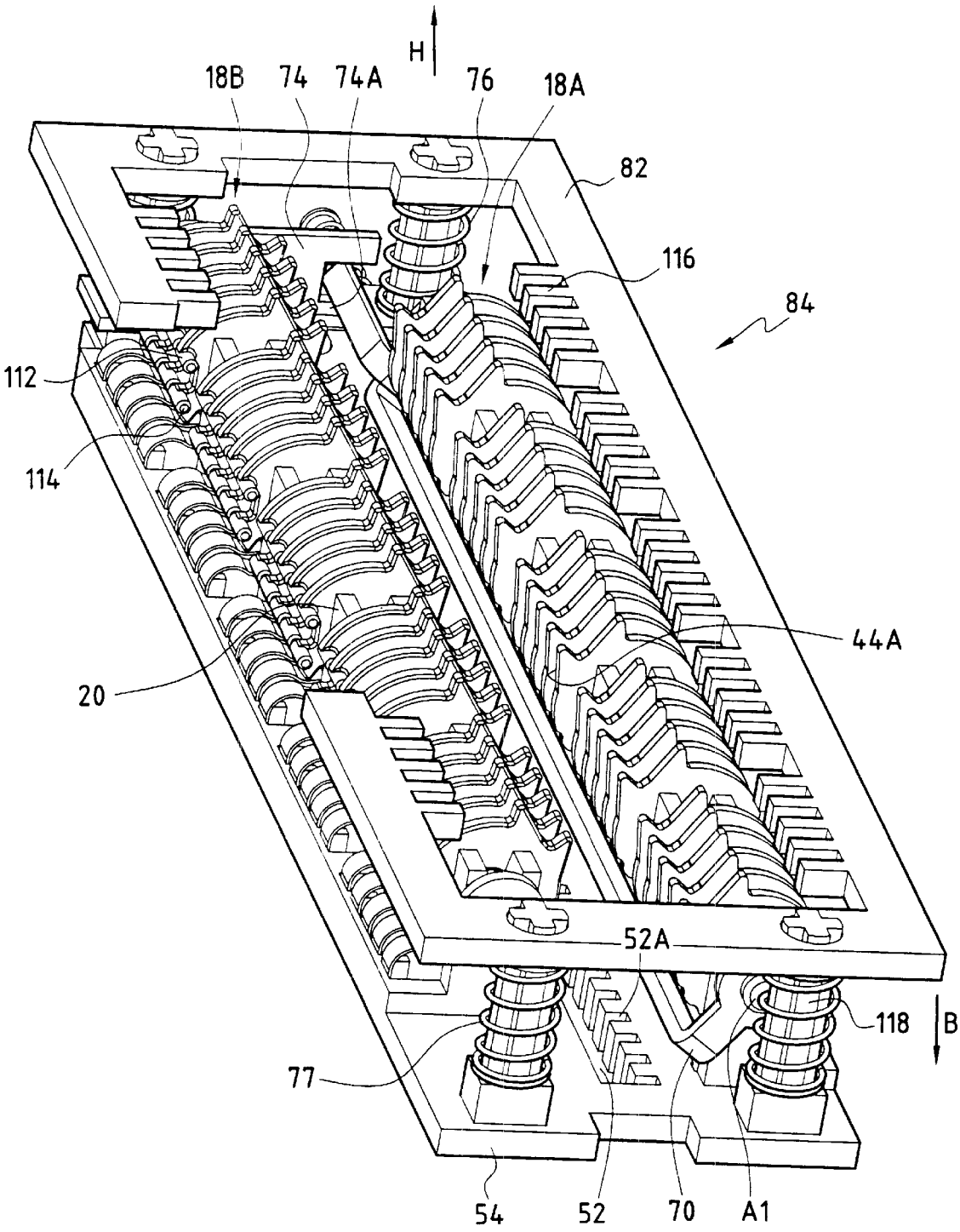
FIG. 9 is a perspective view of the coders and their supports.

FIG. 9 shows an reset bar 70 which is used to reset the coders of the row 18A mounted on the shaft A1 and which is itself mounted to turn about the shaft A1. The bar 70 and the similar bar 72 associated with the coders of the row 18B mounted on the shaft A2 can be seen in section in FIG. 5. The bars 70 and 72 can be moved by an initialization actuator member 74 (see FIGS. 9 and 11). Clearly, if the member 74 is pushed in the direction H, to move outwards away from the support plate 54, its inner arm 74A causes the reset bar 70 to rotate in the direction opposite the first rotation direction F of the coders 18A. At the same time, it causes the bar 72 to rotate in the direction opposite the first rotation direction G of the coders 18B. When they pivot, the reset bars 70 and 72 cooperate with the rear faces 44A of the first indentations 44 of the coders. Accordingly, if the actuator member 74 is pushed outwards far enough, the reset bars 70 and 72 return all the coders to the inactive position. FIG. 9 shows that the actuator member 74 is spring-loaded by return springs 76 towards its lowermost position, in which it does not operate the reset bars.

The actuator member 74 can be pushed in the direction H by a plunger that can be manipulated from the inside of the door on which the lock system is mounted, for example. To allow this, the plate 58 comprises an orifice 78 (see FIGS. 10 and 13) through which a plunger of this kind can pass and the support plate 54 has a notch 80 aligned with that orifice.

Accordingly, to change the combination of the lock system, the stroke limiter bar 56 is actuated to enable the push-buttons T to be depressed by their coding stroke and the reset bars 70 and 72 are actuated to place all the coders in their inactive position; these two operations can be carried out simultaneously, in the above order or in the opposite order. From this starting situation, all that remains is to depress the push-buttons sequentially in compliance with the new combination, which returns the selected coders to their coding position.

Figure 6E:
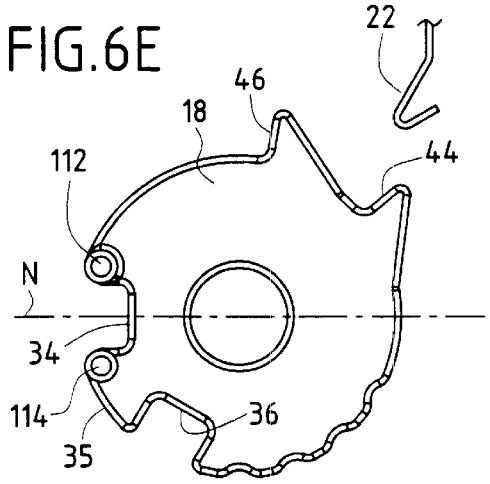
Figure 6F:
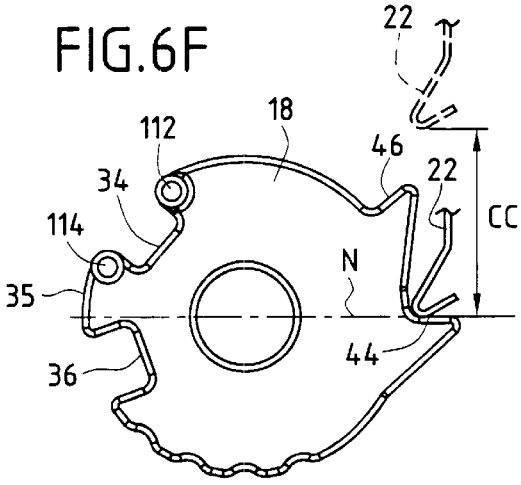

FIG. 6E shows a coder 18 in the inactive position and FIG. 6F shows the same coder in the coding position; these figures show the positions of the first actuator member 22 of the push-button associated with this coder respectively at rest and at the end of the coding stroke CC.

Comparing FIGS. 6A and 6B shows that, the coding stroke CC of the push-buttons being greater than their normal stroke CN, the coder has been turned through an angle greater than its normal rotation angle corresponding to one rotation angular step. Accordingly, simply manipulating the push-buttons enters a new code by moving the selected coders into their coding position.

When coding has been completed, it is sufficient to move the stroke limiter bar 56 back into its first position, in which it limits the stroke of the push-buttons to their normal stroke, operating on the square operating shaft of the actuator cam 68. The reset bars 70 and 72 naturally return to their lowermost position as soon as the plunger ceases to operate on the actuator member 74. Accordingly, when the new combination has been entered by means of the push-buttons, no further displacement of the coders is necessary to place the lock system in the operating situation. It is simply sufficient to return the limiter bar 56 to its position in which it limits the stroke of the push-buttons and to return the coder block to its initial position by resetting the incrementing means that were operated during coding. As explained later, operating the door handle is sufficient to effect this resetting, for example.

The incrementing means of the lock system according to the invention will now be described. The coders 18 are rotatably mounted on the shafts A1 and A2, which are themselves supported by the support plate 54, which also carries the springs 48 determining the sticking points on rotating the coders. FIGS. 9 and 11 shows that a reset member 82 in the form of a frame is also supported by the support 54, relative to which it can move in translation perpendicular to its plane. The incrementing means can move the coder block by one increment as a consequence of the depression of a push-button. The coder block 84 is supported relative to the plate 58 by virtue of the fact that the support plate 54 is carried by the free ends of longitudinal wall members 88 and 90 that project outwards from the plate 58 (see FIGS. 5 and 10).

The lower face of the support plate 54 features guide studs 92 adapted to cooperate with the wall members 88 and 90 to guide longitudinal movement of the support plate. The coders 18 are fastened to the support 54 which cooperates with translation means. The first actuator member 22 of each push-button co-operates with the coders to move them when the push-button is actuated, as already indicated. The second actuator member 24 co-operates with the translation means to move the support by one increment when the push-button is actuated.

Although depressing a push-button moves the coder block 84 by one increment, it is important to prevent the block moving as the same time as the push-button is depressed. To achieve this the actuator members 26 previously referred to also serve as locking members which, while the push-button carrying them is depressed, momentarily prevent movement of the coder block 84.

To be more precise, if a push-button is depressed its second actuator member 24 cooperates with a tooth 94 on the incrementing shaft 50 to turn that shaft through one angular increment in the direction R. Note that it is sufficient for the incrementing shaft to carry four teeth for each actuator member 24 for the system to enable entry of a five-digit code by allowing the coder block 84 to occupy five different positions relative to the push-button support block 86.

Accordingly, in the example shown, and as can be seen in FIGS. 5 and 10, a series of four teeth 94 is associated with each of the push-buttons, i.e. the teeth of each series are disposed under the actuator member 24 of the corresponding push-button.

The means for moving the support 54 in translation comprise a spring member and a mobile abutment adapted to be moved by the second actuator member 24 of a push-button; the spring member produces abutment contact between the support and the abutment member; the locking member is adapted to retain the support against the effect of the spring member when a push-button is depressed and to release that effect when the push-button is released.

To be more precise, the incrementing shaft 50 has a slot 96 near one end which is inclined to the longitudinal and transverse directions of the shaft. In particular, the slot 96 can take the form of a helix (see FIG. 10). The front face 96A of the slot constitutes the mobile abutment previously referred to. The abutment contact between the support 54 and the mobile abutment is obtained by co-operation between an abutment stud 98 that projects inwards from the inside face of the support plate 54 so as to penetrate into the slot 96 and which cooperates with the face 96A of that slot. The spring member for spring-loading this abutment contact is a spring 100 which bears on a fixed part (for example a part of the plate 58) in order to push the stud 98 at all times against the front face 96A of the slot 96.

Figure 11:
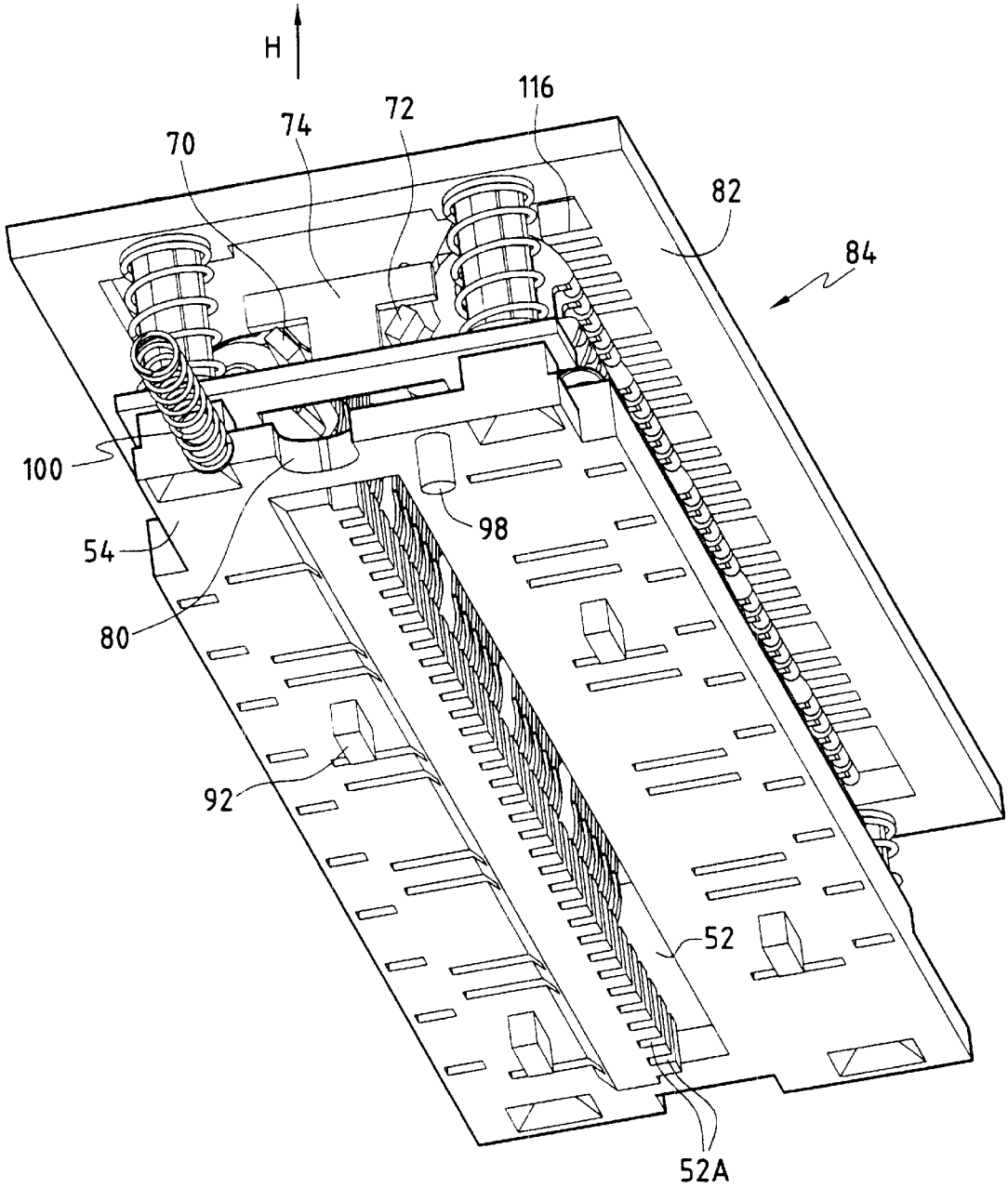
FIG. 11 is a bottom view of FIG. 9, showing another part of the incrementing means.

FIGS. 9 and 11 shows that the longitudinal slot 52 formed in a median region of the support plate 54 has an edge provided with regularly spaced notches 52A. If a push-button is depressed, the locking members 26 consisting of the free end portions of its extension arm 27 engage in two adjacent notches 52A to lock the coder block 84 relative to the push-button support block 86.

However, at the same time, the actuator member 24 associated with the push-button turns the incrementing shaft 50 by one angular increment in the direction R, the effect of which is to move the edge 96A of the slot 96 farther away from the stud 98. As soon as the push-button is released, the locking member 26 escapes from the notches 52A, which frees the support 54 to be moved forward by the continuous return action of the spring 100. This forward movement can continue until the pin 98 again abuts against the front face 96A of the slot 96 in the shaft 50; the shape of the slot 96 and the amplitude of a rotation angular increment of the shaft 50 determine an increment for the movement in translation of the coder block 84 such that movement by that increment positions under the actuator members 22 the push-buttons adjacent those previously there and places new notches 52A under the ends 26 of the arms 27.

A ratchet wheel system prevents the incrementing shaft 50 turning backwards. It carries at its end a toothed wheel 102 which can be seen in FIGS. 8 and 10. A pawl 104 cooperates with the teeth of the wheel to prevent the shaft turning backwards. On a reset, the pawl 104 is lifted by means described below to allow the teeth of the wheel 102 to escape from it.

The incrementing shaft 50 can then be returned to its initial position by a torsion return spring 110 that can be seen in FIG. 10. This constrains the support 54, and therefore the coder block 84, to return to their initial waiting position through co-operation of the lug 98 with the edge 96A of the slot 96.

To perform a reset, it is also important to return to their initial position the coders that were moved by actuating the push-buttons. To this end, each coder has spaced first and second reset surfaces. In this example the reset surfaces are formed on longitudinal studs 112, 114 (see FIGS. 2, 9 and 6A to 6F). The reset frame 82 has teeth 116 on its longitudinal edges that co-operate with the studs 112 and 114 when the frame is lowered (arrow B) so that they are moved inwards, towards the support plate 54. FIG. 9 in particular, in which a portion of the frame 82 is cut away, shows that each tooth 116 is disposed so that it can be inserted between the coder with whose studs it is intended to co-operate and the next consecutive coder.

The operation of the reset frame 82 is explained further with reference to FIGS. 6A to 6D, which show in full line the rest position of the tooth 116 associated with the coder 18 shown, i.e. the position occupied by that tooth when the reset frame 82 is at the greatest distance from the support plate 54. In this connection, referring to FIG. 9, note that the frame 82 is spring-loaded into this position by return springs 76 (which also spring-load the initialization actuator member 74 into its lowermost position) and 77; the springs 76 and 77 are disposed around guide rods 118 which guide movement in translation of the frame 82 relative to the support 54. In FIGS. 6A and 6C the position occupied by the tooth 116 during a reset is shown in dashed line.

Comparing FIGS. 6A and 6B, it is clear that if a coder that is not part of the code is operated in error, so that it occupies its locking position shown in FIG. 6B, moving the frame 82 towards the support plate 54 in the direction of the arrow B causes the tooth 116 to cooperate with the reset stud 112 until the coder is returned to its inactive position shown in FIG. 6A.

Comparing FIGS. 6C and 6D, it is clear that if a coder which is part of the code is operated to occupy its unlocking position shown in FIG. 6D, the same movement of the frame 82 causes the tooth 116 associated with that coder to cooperate with the reset stud 114 until the coder is returned to its coding position shown in FIG. 6C. The spacing of the studs 112 and 114 is such that the stud 112 escapes from the tooth 116 when the coder is in its coding position. The coders which have remained in the inactive or coding position are not rotated about their axes when they are reset. They are only moved in translation with the whole of the coder block by resetting the incrementing means.

Resetting, i.e. returning the coders to a waiting position after an attempt to unlock the lock by operating the push-buttons in compliance with a combination, whether successful or not, therefore necessitates resetting the incrementing means and turning the coders that have been moved to return them to their inactive position (in the case of the coders that are not part of the combination) or to their coding position (in the case of the coders that are part of the code).

To this end, the system comprises a reset actuator member. In this example, the reset actuator member comprises two longitudinal actuator bars 120 disposed on respective opposite sides of the wall members 88 and 90 on the plate 58 (see FIGS. 2, 5, 8). The ends of the two longitudinal bars are connected by transverse bar members to form an actuator frame.

The operation of the reset member is described with reference to FIGS. 2 and 8, in which the bars 120 can be seen more clearly. The bar 120 that can be seen in FIG. 2 comprises an actuator lug 122 formed by its free end on the same side as the square operating shaft of the locking means of the lock. The actuator lug 122 co-operates with an operating cam 124. The actuator lug 122 is engaged in a notch 126 provided for this purpose in the periphery of the cam 124 (see also FIG. 12).

The bar 120 is spring-loaded by a compression return spring 128 so that the lug 122 cooperates with the actuator edge 126A of the notch 126.

Clearly, in the event of an attempt to open the lock, when the cam 124 is turned in the opening direction SO indicated in FIG. 2, it then pushes the bar 120 longitudinally in the direction L1.

Figure 14:
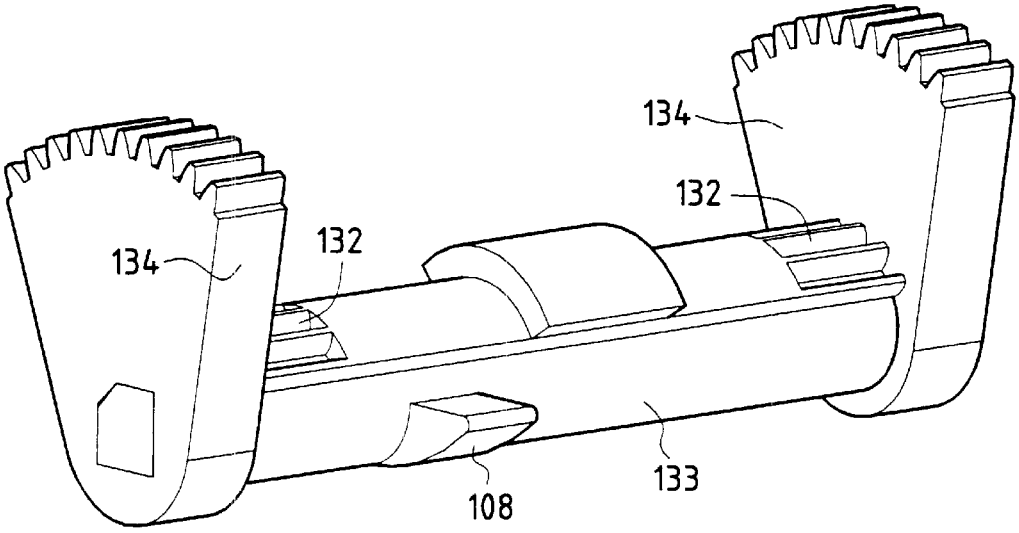
FIG. 14 is a perspective view of a resetting drive shaft.

Each bar 120 carries a rack operating arm 130 which cooperates with a toothed surface 132 of a drive shaft 133 that can be seen more clearly in FIG. 14. The shaft carries two toothed sectors 134, one for the arm 130 of each bar 120. Each of these sectors cooperates with a rack 135A carried by an extension 135 of a bearing frame 83 disposed against the reset frame 82, on the outside. The extensions 135 features stiffener ribs 136.

Figure 8:
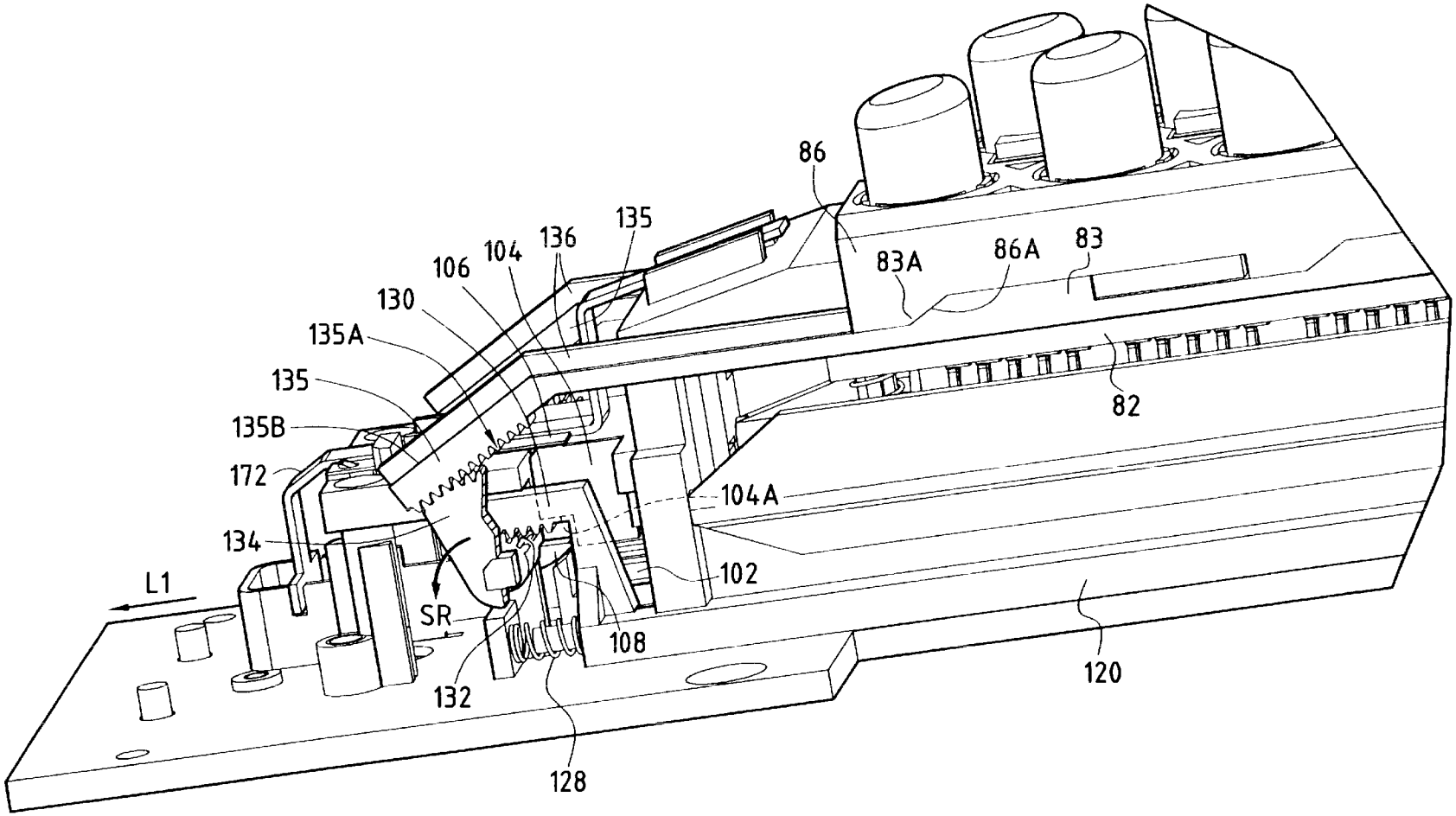
FIG. 8 is a partial perspective view as seen in the direction of the arrow VIII in FIGS. 3 and 4.

Because FIG. 8 is partly cut away in the sector 134, it can be seen that movement in translation of the bars 120 in the direction L1 rotates the toothed sectors 134 in the direction SR because the racks on the operating arms 130 mesh with the toothed surfaces 132; this rotation moves the bearing frame 83 in the direction L1 because the sectors 134 mesh with the racks 135A.

The push-button support block 86 is fixed relative to the plate 58 and its inside surface has ramps 86A inwardly inclined in the direction L1. The outside surface of the bearing frame 83 has ramps 83A adapted to slide against the ramps 86A when the frame 83 moves in translation in the direction L1 or in the opposite direction. The ramps 86A and 83A move the frames 82 and 83 inwards when the frame 83 is driven in the direction L1 without the frame 82 being moved with it in the direction L1. The teeth 116 of this frame can therefore actuate the coders in the manner previously described.

The pawl 104 takes the form of a plate which is normally retained in the teeth of the wheel 102 by a spring 106. The plate has a recess 104A in corresponding relationship with a lug 108 on the shaft 133. When the shaft turns in the direction SR, the lug 108 cooperates with the recess 104 to push the pawl outwards so that the teeth 102 can escape from the pawl.

Of course, a system other than that just described could be envisaged for moving the reset frame 82 inwards in response to a movement in translation in the direction L1 and release the ratchet wheel of the incrementing system.

Unlocking the lock will now be described with reference to FIG. 12. In the conventional way, a square operating shaft 140 can be rotated by actuating a door handle 14. Rotation of the square operating shaft 140 rotates the cam 124 previously mentioned. The locking means (here the bolt 16 shown FIG. 1) are actuated by the output shaft 142. The output shaft is mechanically connected to said locking means in a manner known in the art.

The lock in accordance with the invention comprises coupling means between the operating means (the square operating shaft 140) and the locking means (the bolt 16 or, to be more precise, the output shaft 142). The cam 124 is formed at the inside end of the operating sleeve 144 mounted on the square operating shaft 140 so that the latter drives it in rotation. The cam 124 is formed in a large-diameter portion of the sleeve. Starting from the cam 124, and in the direction towards its outside end, the sleeve 144 has, in succession, an intermediate portion 146 and an end portion 148 having a cylindrical outside surface of small diameter, the diameter of the intermediate portion being between that of the end portion 148 and that of the cam 124. A maneuvering plate 150 is disposed around the intermediate portion 146 and its inside face 150A rests on the shoulder 152 that limits the portion 146 relative to the cam 124. The maneuvering plate has two maneuvering surfaces 150B which project from its inside face and penetrate into notches 152B on the shoulder 152. The edges in contact of the projections 150B and the notches 152 have respective ramp surfaces 150C and 152C.

A coupling pin 154 in the form of a ring 154A from which two lugs 154B extend towards the inside is disposed so that the ring 154A lies around the end portion 148 of the operating sleeve and its two lugs 154B are engaged in slots 146B in the intermediate portion 146.

The output shaft 142 has two slots 142B adapted to be put into corresponding relationship with the slots 146B when the output shaft is capped by the operating sleeve 144. A return spring 158 is disposed between the maneuvering plate 150 and the ring 154A of the coupling pin 154. It pushes the plate against the shoulder 152 and moves the pin 154 outwards. Clearly, if the pin 154 is moved inwards (in the direction of the arrow B) against the action of the return spring, its lugs 154B provide the coupling between the output shaft 142 and the operating sleeve 144 so that, under these circumstances, rotating the square operating shaft actuates the output shaft to unlock the lock.

A torsion spring 160 co-operates with the operating sleeve 144 to return the square operating shaft 140 to its initial position after it is actuated. This is known in the art.

Figure 12:
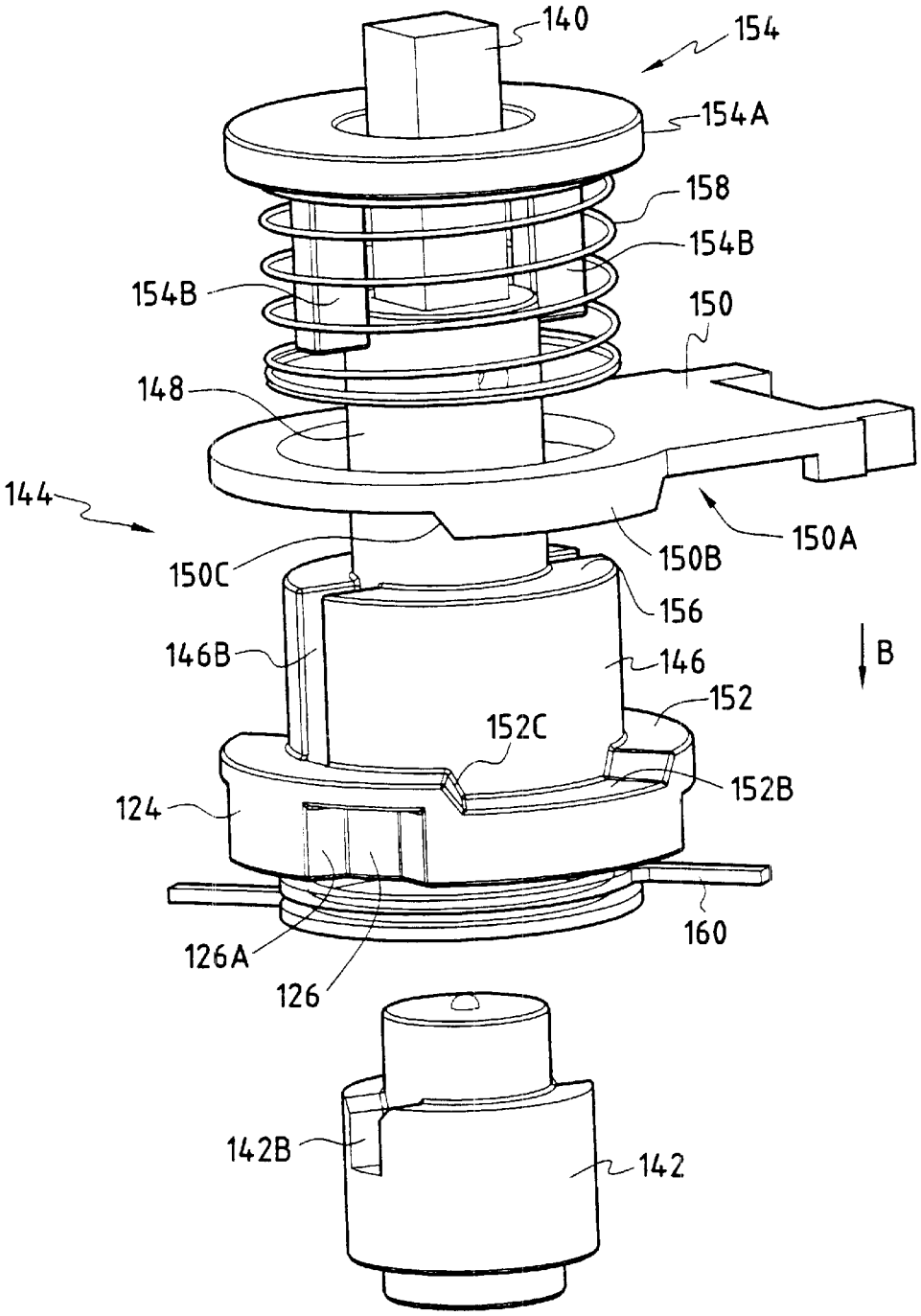
FIG. 12 is an exploded perspective view of various components associated with the operating means of the lock.

The operation of the system shown in FIG. 12 is described next with reference to FIGS. 2, 3 and 12. Remember first of all that the lock system comprises two interlocking bars 38A and 38B which extend longitudinally and can pivot about respective longitudinal axes 39A and 39B. At their outside ends the bars carry respective ribs 37A and 37B (see FIGS. 3 and 5). The coders 18 are disposed between the two bars 38A and 38B, whose ribs 37A and 37B respectively face towards the first series of coders mounted on the shaft A1 and towards the second series of coders mounted on the shaft A2, with which they respectively co-operate.

If the correct combination is entered, so that all the coders are placed either in the inactive position or in the unlocking position, the bars 38A and 38B can be pivoted until said ribs 37A and 37B penetrate into the notches 34 or 36 of the coders. In other words, the interlocking bars can then be moved over their maximum stroke. On the other hand, if the combination entered is wrong, i.e. if at least one of the coders is in the locking position or the coding position, the locking marker 35 of the coder concerned co-operates with the rib 37A or 37B of the interlocking bar 38A or 38B to prevent sufficient pivoting of that bar. In other words, this limits the movement of the interlocking bar concerned to a stroke less than its interlocking stroke.

As can be seen more clearly in FIG. 3, the interlocking bars 38A and 38B have respective bearing arms 162A and 162B. The bearing arms extend beyond the coupling pin 154, i.e. their inside faces are adapted to co-operate with the outside face of the ring 154A of the pin. The interlocking bars 38A and 38B are naturally spring-loaded into the rest position in which the bars 162A and 162B are substantially parallel to the plate 158 by a return spring 164.

The bars 38A and 38B are connected by a pivot coupling. To be more precise, each carries a respective connecting arm 38'A, 38'B which co-operate via a pivot 39 situated in a median plane between the two bars and whose axis is parallel to the pivot axes of the bars 39A and 39B.

Accordingly, if pivoting of one of the two bars 38A and 38B is prevented, the pivot coupling also prevents pivoting of the other bar.

If the square operating shaft is actuated the maneuvering plate 150 is rotated via the notches 152B, in which its projections 150B are engaged. The edges 150D of the plate then co-operate, in the driving direction of the square shaft (which depends on the direction in which the door on which the lock is mounted opens), either with the interlocking bar 38A to turn it in the direction SA or with the bar 38B to turn it in the direction SB (FIG. 3). During this pivoting, the bearing arms 162A and 162B tend to push the coupling pin 154 towards the plate 158.

If the correct combination has been entered, so that the arms 38A and 38B can pivot through their interlocking stroke, the bearing arms 162A and 162B push the pin until its coupling lugs 154B penetrate into the slots 142B to couple the output shaft 142 to the square operating shaft 140, which unlocks the lock.

On the other hand, if the interlocking bar 38A or 38B can pivot only through a stroke less than the interlocking stroke because it is blocked by a coder in an incorrect position, the bearing engagement of the arm 162A or 162B on the pin 154 is not sufficient for its lugs 154B to penetrate into the slots 142B, and the output shaft 142 is therefore not coupled to the square operating shaft 140. Because of the pivot coupling between the bars 38A and 38B, and regardless of the driving direction of the square shaft, the two bars must be able to pivot through their interlocking stroke for the arms 162A and 162B to push the pin 154 far enough back.

If this is not the case, when the square operating shaft rotates, the cam 124 rotates the maneuvering plate 150 until the edge 150D of that plate abuts on fixed members, here the bearing supports 40A or 40B. The ramps 150C then slide over the ramps 152C and move the maneuvering plate 150 slightly outwards, without the latter opposing rotation of the square operating shaft.

Accordingly, if the correct combination has not been entered, the square operating shaft turns freely without driving the unlocking means of the lock.

In any event, the cam 124 turns sufficiently for its notches 126 to drive the reset actuator bars 120 previously mentioned to effect a reset.

The lock in accordance with the invention further comprises means for enabling a free passage. The operation of the stroke limiter bar 56 has already been explained, in particular with reference to FIG. 10. Using operating means comprising in particular an operating lug 64, the bar can moved in the direction L1 from its rest position, in which it limits the stroke of the push-buttons to their normal stroke, to a coding position, in which it allows the push-buttons to be depressed farther.

The end of the stroke limiter bar 56 near the square operating shaft 140 carries a forced engagement plate 166 capable of co-operating with the coupling pin 154 to hold the latter in a pushed inwards position in which its coupling lugs 154B are engaged in the slots 142B of the output shaft 142. To this end, it is necessary to move the stroke limiter bar 56 in the longitudinal direction L2 opposite the direction L1. To this end, the bar carries an operating lug 167 which passes through a slot 168 in the plate 58 so that it can be driven by an operating cam 170. Using an square operating shaft accessible from the inside of the door on which the combination is mounted, the cam 170 can be actuated so that it cooperates with the lug 167 to move the bar 56 in the direction L2. Note that the cams 168 and 170 are made so that they can be actuated without impeding each other.

The lock system advantageously comprises an indicator of activation of the free passage function. For example, the stroke limiter bar 56 carries at the end opposite the square operating shaft 140 an indicator plate 172 (FIG. 2). The casing 13 of the lock system comprises a window 13' disposed so that, when the bar 56 is in its free passage position, a particular part of the plate 172 faces this window, for example a colored marker.

The indicator can serve generally to indicate an activation state of the lock. The plate 172 can therefore have three markers locating under the window 13' to indicate, respectively, a normal operating state of the lock (rest position of the bar 56), the free passage function (movement of the bar 56 in the direction L2), and a coding position (entry of a new code, movement of the bar 56 in the direction L1).

What is claimed is:

1. A combination lock system comprising a set of push-buttons that can be actuated in compliance with a combination, a set of series of coders, in which each series is associated with a push-button, incrementing means for placing the coders of each series successively in a position to be operated by actuating a push-button, coding means for defining a waiting configuration of the coders in which the coders selected for the combination occupy a coding position and the coders not selected for the combination occupy an inactive position, actuation of the locking means of the lock being possible if the selected coders have been operated by actuating push-buttons in compliance with the combination, the system further comprising means for returning the coders to the waiting configuration after actuation of the push-buttons, and means for authorizing two actuation strokes of the push-buttons, namely a normal stroke and a coding stroke, the normal stroke being such that a push-button actuated over that stroke causes the movement of a selected coder from its coding position to a non-locking position or the movement of an unselected coder from its inactive position to a locking position preventing unlocking, while the coding stroke is such that a push-button actuated over that stroke causes a coder to be moved from its inactive position to its coding position, and the system further comprising means which, to enable entry of a new coded combination, place all the coders in the inactive position and authorize actuation of the push-buttons over their coding stroke.

2. A system according to claim 1, wherein the movement of a selected coder from its coding position to its unlocking position is the same as the movement of an unselected coder from its inactive position to its locking position and wherein actuating the push-buttons affects only the incrementing means and the coders.

3. A system according to claim 1, wherein each coder has spaced first and second unlocking markers and wherein, in the unlocking position of a selected coder, the second unlocking marker of said coder is disposed in corresponding relationship to the first unlocking markers of the coders in the inactive position.

4. A system according to claim 3, wherein each coder has spaced first and second actuation surfaces respectively adapted to cooperate with a push-button in order, when the push-button is depressed, to cause the coder to be moved between its inactive position and its locking position and between its coding position and its unlocking position.

5. A system according to claim 1, wherein each coder has spaced first and second reset surfaces and wherein the means for returning the coders to the waiting configuration after the push-buttons are actuated comprise a reset member adapted to cooperate with the first reset surfaces of the coders occupying the locking positions to return said coders to their inactive positions and to cooperate with the second reset surfaces of the coders occupying their unlocking positions to return said coders to their coding positions.

6. A system according to claim 1, wherein each push-button has an abutment arm and comprises a stroke limiter having abutment surfaces, said limiter being adapted to be moved between a first position in which the abutment surfaces face abutment arms of the push-buttons to limit the stroke thereof and a second position in which said abutment surfaces are moved away from the abutment arms to authorize movement of the push-buttons over their coding stroke.

7. A system according to claim 1, wherein the coders are rotary coders and can be moved in a first rotation direction by actuating push-buttons and moved in a second, opposite rotation direction to be returned to the waiting configuration after the push-buttons are actuated.

8. A system according to claim 1, wherein the coders are fastened to a support cooperating with translation displacement means, wherein each push-button comprises a first actuator member adapted to cooperate with a coder to cause said coder to be moved when the push-button is actuated and a second actuator member adapted to cooperate with said translation displacement means to cause the support to be moved over an incrementation step by the actuation of the push-button.

9. A system according to claim 8, wherein each push-button further comprises a locking member adapted to cooperate with the support to prevent temporarily movement of the latter when the push-button is depressed.

10. A system according to claim 9, wherein the translation displacement means for the support comprise a spring member and a mobile abutment member adapted to be moved by the second actuator member of a push-button, the spring member providing abutment contact between the support and the mobile abutment member, and the locking member being adapted, when a push-button is depressed, to retain the support against the effect of the spring member and to release that effect when the push-button is released.

11. A system according to claim 1, comprising coupling means between the operating means of the lock and the locking means thereof, said coupling means at rest having a non-interlocked configuration, and the system further comprising means so that, when the push-buttons have been actuated in compliance with the correct combination, the coupling means have an interlocked configuration in which the locking means are coupled to the operating means of the lock.

12. A system according to claim 11, comprising an interlocking member adapted to be moved by manipulating the operating means of the lock over an interlocking stroke to move the coupling means into their interlocking configuration, the presence of at least one coder in the coding position or the locking position limiting the displacement of said interlocking member to a stroke less than the interlocking stroke, insufficient to move the coupling means into their interlocking configuration.

13. A system according to claim 12, comprising means for providing a free passage function adapted to authorize actuation of the locking means of the lock by the operating means of said lock independently of actuation of the push-buttons, and wherein the means providing the free passage function comprise means for maintaining the coupling means in their interlocking configuration.

14. A system according to claim 1, comprising means for providing a free passage function adapted to authorize actuation of the locking means of the lock by the operating means of said lock independently of actuation of the push-buttons.

15. A system according to claim 14, comprising an indicator of the activation state of the lock enabling at least activation of the free passage function to be indicated.

16. A system according to claim 1, wherein the means for returning the coders to the waiting configuration after the push-buttons are actuated comprise a reset member that can be actuated by manipulating the operating means of the lock.

* * * * *